US009064369B2

(12) United States Patent
Schueller et al.

(10) Patent No.: US 9,064,369 B2
(45) Date of Patent: Jun. 23, 2015

(54) WAGERING GAME, GAMING MACHINE AND NETWORKED GAMING SYSTEM WITH CUSTOMIZABLE PLAYER AVATAR

(75) Inventors: Darren Schueller, Austin, TX (US); Michael Conway, Austin, TX (US); William Garretsen, Austin, TX (US); Jennifer Schulze, Austin, TX (US); Michael Wabschall, Austin, TX (US); Clint Owen, Austin, TX (US); JP Cody, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 804 days.

(21) Appl. No.: 12/818,402

(22) Filed: Jun. 18, 2010

(65) Prior Publication Data

US 2011/0244952 A1 Oct. 6, 2011

Related U.S. Application Data

(60) Provisional application No. 61/321,406, filed on Apr. 6, 2010.

(51) Int. Cl.
*A63F 9/24* (2006.01)
*G07F 17/32* (2006.01)

(52) U.S. Cl.
CPC ..... *G07F 17/32* (2013.01); *G07F 17/3262* (2013.01)

(58) Field of Classification Search
USPC ..... 463/9, 20, 25, 42, 43, 30; 705/14, 3, 1; 715/757
See application file for complete search history.

(56) References Cited

U.S. PATENT DOCUMENTS

| | | | | |
|---|---|---|---|---|
| 6,227,974 | B1 | 5/2001 | Eilat et al. | |
| 6,632,138 | B1 * | 10/2003 | Serizawa et al. | 463/6 |
| 7,090,577 | B2 * | 8/2006 | Serizawa et al. | 463/6 |
| 7,465,231 | B2 | 12/2008 | Lewin et al. | |
| 7,593,740 | B2 * | 9/2009 | Crowley et al. | 455/456.3 |
| 7,690,998 | B2 * | 4/2010 | Okada | 463/43 |
| 2002/0028706 | A1 * | 3/2002 | Barnard et al. | 463/26 |
| 2002/0090990 | A1 | 7/2002 | Joshi et al. | |
| 2003/0013516 | A1 | 1/2003 | Walker et al. | |
| 2003/0064807 | A1 | 4/2003 | Walker et al. | |
| 2003/0114218 | A1 * | 6/2003 | McClintic | 463/25 |
| 2003/0195024 | A1 | 10/2003 | Slattery et al. | |
| 2003/0199312 | A1 * | 10/2003 | Walker et al. | 463/25 |
| 2003/0216169 | A1 * | 11/2003 | Walker et al. | 463/25 |
| 2003/0220133 | A1 * | 11/2003 | Walker et al. | 463/20 |
| 2003/0224852 | A1 * | 12/2003 | Walker et al. | 463/20 |
| 2004/0198489 | A1 | 10/2004 | Kaminkow et al. | |

(Continued)

OTHER PUBLICATIONS

PCT, International Search Report for PCT application No. PCT/US2011/031462 dated Jun. 17, 2011 (2 pages).

(Continued)

*Primary Examiner* — Tramar Harper
(74) *Attorney, Agent, or Firm* — Nathan Calvert, Esq.; Russell D. Culbertson, Esq.; JP Cody, Esq.

(57) ABSTRACT

A method, gaming machine, and networked gaming system are disclosed for operating a wagering game that includes an interface activate-able by a player; a set of game plays, with at least one of the game plays occurring after activation of the interface by the player; and a persistent customizable player avatar interactive with a player and the wagering game, and, providing entertainment and companionship for a player during game play.

25 Claims, 15 Drawing Sheets

(56) References Cited

U.S. PATENT DOCUMENTS

| | | | | |
|---|---|---|---|---|
| 2005/0192085 | A1 | 9/2005 | Iwamoto | |
| 2006/0046807 | A1* | 3/2006 | Sanchez | 463/9 |
| 2007/0021200 | A1* | 1/2007 | Fox et al. | 463/30 |
| 2007/0060348 | A1 | 3/2007 | Svanas | |
| 2007/0259713 | A1 | 11/2007 | Fiden et al. | |
| 2008/0032800 | A1 | 2/2008 | Liu et al. | |
| 2008/0059304 | A1* | 3/2008 | Kimsey | 705/14 |
| 2008/0076519 | A1 | 3/2008 | Chim | |
| 2008/0125221 | A1* | 5/2008 | Ward et al. | 463/32 |
| 2009/0048918 | A1* | 2/2009 | Dawson et al. | 705/14 |
| 2009/0111567 | A1* | 4/2009 | Park | 463/20 |
| 2009/0298039 | A1* | 12/2009 | Glazier | 434/362 |
| 2010/0030578 | A1* | 2/2010 | Siddique et al. | 705/3 |
| 2010/0048302 | A1* | 2/2010 | Lutnick et al. | 463/42 |
| 2010/0057478 | A1* | 3/2010 | Hamilton et al. | 705/1 |
| 2010/0083139 | A1* | 4/2010 | Dawson et al. | 715/757 |
| 2010/0248818 | A1* | 9/2010 | Aoki et al. | 463/25 |
| 2010/0304862 | A1* | 12/2010 | Coleman et al. | 463/32 |
| 2011/0021109 | A1* | 1/2011 | Le et al. | 446/300 |
| 2011/0086702 | A1* | 4/2011 | Borst et al. | 463/30 |
| 2011/0143834 | A1* | 6/2011 | Guinn et al. | 463/25 |
| 2011/0201414 | A1* | 8/2011 | Barclay et al. | 463/25 |
| 2011/0223993 | A1* | 9/2011 | Allen et al. | 463/30 |

OTHER PUBLICATIONS

PCT, Written Opinion of the International Searching Authority for PCT application No. PCT/US2011/031462 dated Jun. 17, 2011 (6 pages).

* cited by examiner

WAGERING GAME, GAMING MACHINE AND NETWORKED GAMING SYSTEM WITH CUSTOMIZABLE PLAYER AVATAR

CROSS-REFERENCE TO RELATED APPLICATIONS

This application claims the benefit of, and incorporates by reference pursuant to 35 U.S.C. §119(e) et seq., U.S. Provisional Patent Application No. 61/321,406 filed Apr. 6, 2010, and entitled "WAGERING GAME, GAMING MACHINE AND NETWORKED GAMING SYSTEM WITH CUSTOMIZABLE PLAYER AVATAR".

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention is directed to wagering games, gaming machines and networked gaming systems and methods and, more particularly, to wagering games, gaming machine and networked gaming systems and methods including customizable player avatars or character images.

2. Description of the Related Art

In the prior art, various types of gaming machines, systems, and methods have been developed with different features to captivate and maintain player interest. In general, a gaming machine allows a player to play a game in exchange for a wager. Depending on the outcome of the game, the player may be entitled to an award which is paid to the player by the gaming machine, normally in the form of currency or game credits. Gaming machines may include video presentations, flashing displays, lighted displays, or sound effects to capture a player's interest in a gaming device.

Another important feature of maintaining player interest in a gaming machine includes providing the player with many opportunities to win awards, such as cash or prizes. Additionally, gaming establishments frequently offer player cards to players which may have various perks associated with them, such as the accumulation of player points redeemable for cash, prizes, or services.

While gaming establishments have had a great deal of success in generating player interest, there continues to be an ongoing need to develop new games and attractions to maintain current player interest and to develop new player interest.

SUMMARY OF THE INVENTION

In accordance with an embodiment of the present invention, a wagering game includes an interface activatable by a player; a set of game plays, with at least one of the game plays occurring after activation of the interface by the player; and an interactive customizable player avatar providing entertainment and companionship for a player during game play. The player avatar may be animated and may interact with the game and player, such as by celebratory dancing when the player hits a jackpot or by saying 'Nice job!'. The avatar may be selectable from a set of images or models by the player using the interface. The wagering game may award tokens or virtual currency to a player which may be used to purchase items to customize the player's avatar. The wagering game may award the player an opportunity to select from a set of items to customize the player's avatar. The player's avatar may be persistent, so as to return in its customized state at later gaming sessions after player identification information is input through the interface.

In accordance with another embodiment of the present invention, a gaming machine includes a wagering game, a processor configured to operate the wagering game, and a player interface connected to enable a player to play the wagering game and interact with a player avatar module. The gaming machine operable to display a customizable player avatar interactive with the wagering game and player.

In accordance with another embodiment of the present invention, a networked gaming system includes a plurality of gaming machines connected through a network to a server, at least one of the gaming machines including a wagering game and interactive customizable gaming avatar operable by a player.

In accordance with another embodiment of the present invention, a method of operating a wagering game includes the step of providing an interactive customizable player avatar.

In accordance with another embodiment of the present invention, a method of operating a gaming machine played by a player includes the steps of accepting a wager from a wager-input mechanism, initiating play of a first game according to the wager, and providing an interactive customizable player avatar.

In accordance with another embodiment of the present invention, a method of operating a networked gaming system includes the steps of connecting a plurality of gaming machines to a host computer, and operating a wagering game together with a customizable player avatar interactive with the wagering game and a player.

Features and advantages will become apparent from the following detailed description, taken in conjunction with the accompanying drawings, which illustrate by way of example, the features of the various embodiments.

DETAILED DESCRIPTION OF EMBODIMENTS OF THE INVENTION

Referring generally to the drawings which are presented for illustrative purposes, one or more embodiments are shown and described of a wagering game with an interactive customizable player avatar providing entertainment and companionship for a player during game play, where an avatar may be defined as an alter ego, a virtual, or pseudo representation of a player; a companion, a good luck charm, etc., each of which may be represented audio-visually with two or three dimensional still and/or video images on one or more displays and audio sound tracks, and, which may be interactive with the respective player and game activity. It will be appreciated that the gaming apparatus and system may vary as to configuration and as to details of the parts, and that the method may vary as to details, partitioning, and the order of the acts, without departing from the inventive concepts disclosed herein.

Figure 1:
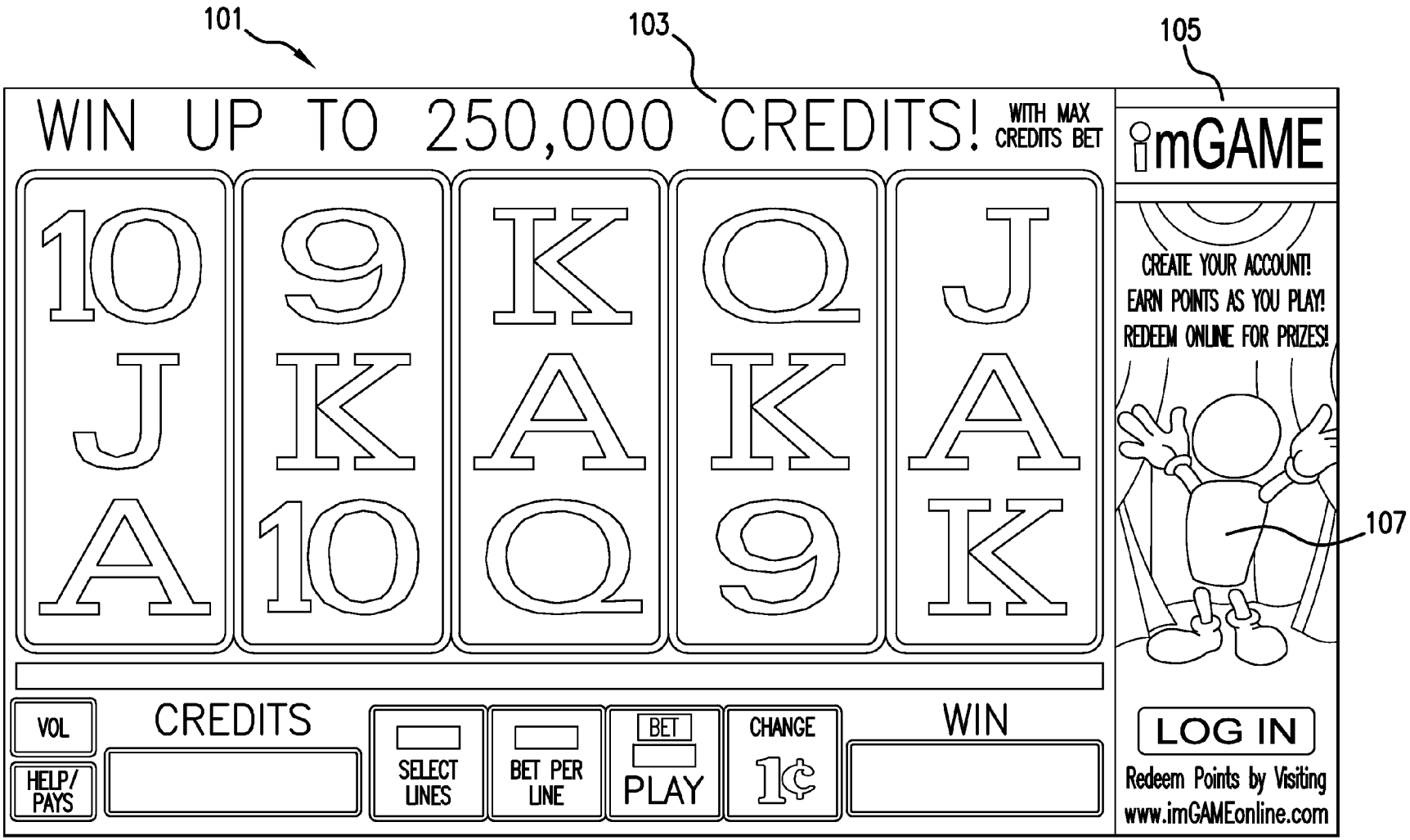
FIG. 1 is an attract mode screenshot of a wagering game with a customizable player avatar in accordance with an example embodiment of the present invention.

Referring to FIG. 1, attract mode screenshot 101 is shown with wagering game panel 103 and avatar panel 105 in accordance with an example embodiment of the present invention. Attract mode screenshot 101 may be instantiated in various combinations of hardware and software, such as a touch panel tablet, conventional gaming machine, personal computer, and/or network connected device with a player interface and processor configured to present a wagering game.

Wagering game panel 103 includes a 5-reel display showing 3 symbols per reel wherein each of the reels independently rotate or give the illusion of rotating upon initiation of a game by a player through a player interface and randomly or pseudo-randomly present an outcome of symbols upon completion of a game. The wagering game is initiated by the player by placing a wager using credits entered or won by the player and displayed in the Credits meter display area. The player may wager on one or more paylines which are defined by the game to cross a symbol area on each of the reels. In the event that the outcome of one or more wagered upon paylines is a winning outcome, the win amounts are determined in accordance with a paytable, shown in the Win display area, and the player credits are incremented accordingly and shown in the Credit display area. Also, shown are icons for number of lines selected, credits per line wagered, Play, and denomination wherein each of the icons may provide a player interface or display the result of a player initiated action, such as the Select Lines icon may display the number of lines selected or may be activatable by a player to select one or more lines depending upon the game. Similarly the player may select one or more credits to wager upon each selected line and the amount of credits per line may be displayed at Credits/Line icon, which may also be activatable as a player interface. Similarly, the Play icon may illuminate when a game is initiated and may be activatable by a player to initiate the game.

Avatar (imGame) panel 105 presents a non-wagering game for additional player entertainment and companionship while the player plays the wagering game displayed in wagering game panel 103 and which operates interactively with the wagering game and player by animating customizable player avatar 107 (iPAL avatar) responsive to player and wagering game activity, such that the player's avatar may act as a companion, playing partner, mascot, good luck charm, or status symbol (as the player customizes the player's avatar). For example, the interaction of the player avatar with the player may be in the form of animations or spoken dialog when various events occur during the game. For example, when the player logs in or uploads credits associated with the game, the player avatar may welcome the player. If the player hasn't logged in, the player avatar may give a generic welcome and invitation to log in, the player can receive a personalized welcome upon log in. When the player logs out or cashes out, the player avatar may say 'So long, partner, catch you next time'.

In further examples, the player avatar may play a dance animation and possibly say "Nice job!" when the player wins an award from the base or primary wagering game, such as one or more credits paid to the player in accordance with a paytable or bonus, from a feature or another game, or from the avatar feature or game. The celebrations by the player avatar may increase as the player wins higher awards. In addition, the player avatar may provide congratulations and may be characterized to may be characterized to provide an additional avatar prize or award to the player in a presentation rendered through avatar game programming executed through a processor; alternatively, the player avatar may be characterized as a proxy for the player and receives the avatar prize or award on behalf of the player, such that the prize or award may be avatar currency or points which are applied to the player's cumulative total of avatar points, currency, or other awards. In further instances, a player's avatar celebration of an award may be broadcast to other players; for example, a player's avatar celebration may be displayed on an overhead display or transmitted and displayed in a designated display area of one or more other player's gaming devices.

Similarly, when the player loses, the player avatar may provide commiserations to the player and the expressions of commiseration may increase as the player's losses increase plus the player avatar may be characterized to provide a consolation avatar prize or award to the player in a presentation rendered through avatar game programming executed through a processor; alternatively, the player avatar may be characterized as a proxy for the player and receives the avatar prize or award on behalf of the player, such that the prize or award may be avatar currency or points which are applied to the player's cumulative total of avatar points, currency, or other awards.

In other instances, when the player places a wager and activates the game, the player avatar may express anticipation or excitement as the player waits to learn the game outcome. Thus, the player avatar may effectively mirror the highs and lows of the player emotions during play of the game. The interactive capability of the player avatar could be further enhanced in the case where player biometric readings may be obtained and used by the player avatar programming so that the player avatar includes animation and dialog corresponding to the player biometric readings.

In further instances, one or more games or features, played or activated through game play or by the player, may award virtual goods to a player, such as offering a player an opportunity to select an item from a set of selections, such as a shirt, jacket, blouse, skirt, shoes, hair, beard, mustache, glasses, additional accessories, or combinations or variations thereof, as a customization to be applied to the player's avatar. Such an award may be associated with one or more winning outcomes or may be triggered randomly or pseudo-randomly during one or more game play sessions of one or more players. For example, each player may have a player-centric random or pseudo-random award generator associated with the player's game play at one or more sessions; alternatively, a counter may be used to trigger an award and then be reset to begin a new count for a subsequent award. In another example, a gaming device may include a game or game device-centric random or pseudo-random award generator associated with the game play at the gaming device independent of the specific player. For example, the random number generator (RNG) may have a probability of triggering an avatar award once in each fifty plays, once in each one hundred credits played, or once in each one hundred credits won or lost. The RNG may be operated or triggered on each play to determine whether an avatar award has been won; alternatively, the RNG may be limited to operate or trigger an award only with each maximum bet play.

In a further option, the player avatar may be a still image, as opposed to animated; for example, an option through selectable buttons on the avatar panel may be provided to the player to animate or freeze the player avatar image, or simply provide a still image in the case where a player may want to minimize or reduce the player avatar interactivity. The player may further have an option to close or minimize the avatar panel whereby the wagering game display may expand to cover the entire display field; in which case, a selectable button may be provided for the player to re-open or close the avatar panel.

In one or more embodiments, Avatar panel 105 may additionally present a player with additional options, such as to play additional wagering games including lottery, race track, table game, and slot-style game, or, to purchase tickets to a show or make table reservations, and/or to enter or use a credit or debit card to perform a transaction.

In one or more embodiments, Avatar panel 105 may be eliminated by the player so that the entire screen presents the wagering game.

In generic mode, avatar panel 105 shows customizable player avatar 107 in a generic state and a Log In icon. New players may be prompted to join and allowed to make some simple modifications to the player avatar, such as providing the player avatar with a name and a hat. Generic player avatar 107 may be enabled to perform basic behaviors for new players, such as small win celebrations and touch reactions. Also, the player may be provided an opportunity to choose from several pre-defined two- or three-dimensional models representing various human (and non-human) characters and body forms to use during their gaming experience. Customizable player avatar 107, as shown, has the shape of the letter 'i' body form, such that the generic version of customizable player avatar 107 when displayed together with the letter 'm' and the word 'game' provide the suggestion of the sentence 'I am game'. The player's selection becomes their "base avatar" which may be saved for a subsequent gaming session and later customization. In one or more embodiments, the player may have an option later to change the player's base avatar to a different selection. The generic base player avatar may be simple in appearance, with basic clothing and a few ambient animations. (i.e.: Simple head turning, breathing, etc.). In one or more embodiments, the generic base avatar may have more complex capabilities, such as cheering, dancing, singing, etc.; although, these may be premium features which a player may obtain by purchases or redemption of imGame points.

The Log In icon may be activatable to identify a player and to restore the player's customized player avatar along with any prior accumulated imGame points. The imGame points (tokens or virtual currency) may be accumulated by the player as a function of the player's game play at the wagering game and in accordance with imGame rules. In order to accumulate imGame points, the imGame rules may define an imGame point as equal to one hundred waggered credits, so that the player accumulates an imGame point for each one hundred credits wagered in the wagering game. In addition to accumulations from playing the wagering game, a gaming establishment or the imGame provider may award additional imGame points or player avatar customization items or features for returning players as a loyalty reward for playing the same or another wagering game that is connectable with avatar panel 105. In another example, imGame (avatar) points may be accumulated as a function of game activity; for example, in instances where the outcome is not a winner, the avatar game (or feature) may reward a player with avatar points in accordance with a predetermined amount wagered and lost during each game play. Alternatively or additionally, avatar points may be awarded with each win or selected wins, such as a jackpot; and, the amount of avatar points awarded may be in accordance with predetermined win amounts. For example, in the case of a player losing an accumulated amount of $100, the player may be awarded 1000 avatar points. This accumulation of losses may be stored by either the primary game or the avatar game; and once a predetermined threshold is met, the avatar point display may be incremented accordingly. Similarly, additional avatar points may be awarded in accordance with player wins.

To save any accumulated imGame points, a player establishes an imGame account name and password. In one or more embodiments, the player account and password from a given gaming facility may be used to identify the imGame player account. At the end of a gaming session, the imGame player account information may be used to store accumulated imGame points and the player's avatar in its current state, so that the player's avatar and imGame points may be restored at the beginning of a subsequent gaming session.

As indicated on avatar panel 105, a player may use imGame points to accumulate prizes and awards associated with imGame. To do so, for example following a gaming session, a player may be able to log onto a specified website, such as 'www.imGAMEonline.com', through a network connected device. Using the imGame player account name and password, the player may gain access to the player's accumulated imGame points and the player's avatar in the previously stored state. With imGame points, the player may customize the player's avatar by purchasing items or attributes for the player's avatar. In one or more embodiments, the player may use imGame points or a credit card to play one or more onsite imGame enabled games which may yield additional imGame points or prizes to the player. Additionally, players may buy or sell their avatars, awards, points, etc. to other players using either virtual or conventional currency. The customized player avatar may be stored for later recall by the player during a subsequent gaming session. So that when the player subsequently initiates a gaming session and submits identification information associated with the player's imGame account, the player's customized avatar will be displayed with the items or attributes acquired by the player for the player's avatar. Example player avatar customizations may include: Avatar customizations: avatar name, clothes, background, props, pets, girlfriend/boyfriend, win celebrations, or touch reactions. Players may also obtain trophies for landmark achievements (in-game and at the website).

In one example, the characteristics that define the player avatar may be stored on a central server, so that the player can use their avatar no matter where they are playing. When the player logs in to a gaming device, such as a Multimedia gaming machine configured to display imGame panel 105. The gaming device may make a request to a central avatar server, which returns a descriptor of which items the player's customized avatar character has in its current state, as well as the appearance characteristics. (I.e.: hair color, skin color, hair style, etc.) that the player set up such as when they created the avatar. Every gaming machine that supports this functionality is shipped with the basic set of graphic assets that comprise all of the various skin, hair, clothing, and model styles supported. Updates to those assets and "special items" (i.e.: items that are of specific significance for various reasons, like time of year, holidays, amount won, etc.) can be downloaded by the gaming device on a regular basis, or on demand.

Extensive play statistics may also be gathered for each player and attached to the player's account, and displayed along with their avatar on the website. Stats like "Highest Single Win", "Total Earnings", "Total Spent", "Win/Loss Ratio", etc. would allow players to compare statistics and set up teams or "clans" (i.e.: collections of players playing as a group) who would compete against other clans for bragging rights or other prizes. The online player avatar website may be the main portal for all of this activity.

In another example, if a player account has been associated with the player's imGame account, then the player may use a player card to provide the identification information needed to recall the player's customized avatar and accumulated imGame points. In such case, the user interface utilized by the player may be connectable to a player database containing the player's imGame account name, accumulated imGame points, and current state of the player's avatar. The database information may be updateable as described through the www.imGAMEonline.com website or at the end of a gaming session by the player.

In another example, the player's imGame data may be stored on a portable storage medium, such as a player card with a magnetic strip, a CD, or a flash memory dongle, readable by a gaming device or a network connectable device, such as a personal computer, mobile phone, or tablet, such that the imGame data and any updates thereto may be associated with the player upon input of identifying information, such as a player card, at a gaming device. In such case, the player's persistent imGame data may be retained on the player's card or may be uploaded to the player's account with the casino. In one or more embodiments, a ticket or coupon may be issued from a gaming device with the player's imGame data or tag information digitally printed, such as through bar-coding; and the player may insert the ticket into a ticket reader for recovery of the player's imGame data at a different gaming device, either in the same or a different casino, in order to begin another gaming session, or, insert the ticket or ticket data at a network-connected device in order to login at www.imGAMEonline.com and redeem points or transact other business, such as purchase additional imGame points or earn imGame points by engaging in an activity, such as signing up for a credit card or making reservations for dinner or a show. In the event that tag information is stored on the ticket or coupon, then the imGame player data will be accessed from a storage facility and uploaded to the online website through a player request initiated with a device reading the ticket or coupon.

In other instances, the imGame (or avatar) points may be redeemable for virtual (or avatar) currency which may be used to purchase various virtual accessories or customizations for the player's avatar, or purchase physical items, such as a hat, shirt, jacket, key ring, etc. which may have an imGame logo or emblem. in instances where the player has earned or purchased a virtual avatar trophy or medal, the player may be able to additionally purchase a physical emblem fixable to the player's shirt, jacket, or hat. In further instances, a player may be able to gift the player's accumulation avatar points or currency to another player or person for use in acquiring customizations or conducting various available transactions.

Figure 2:
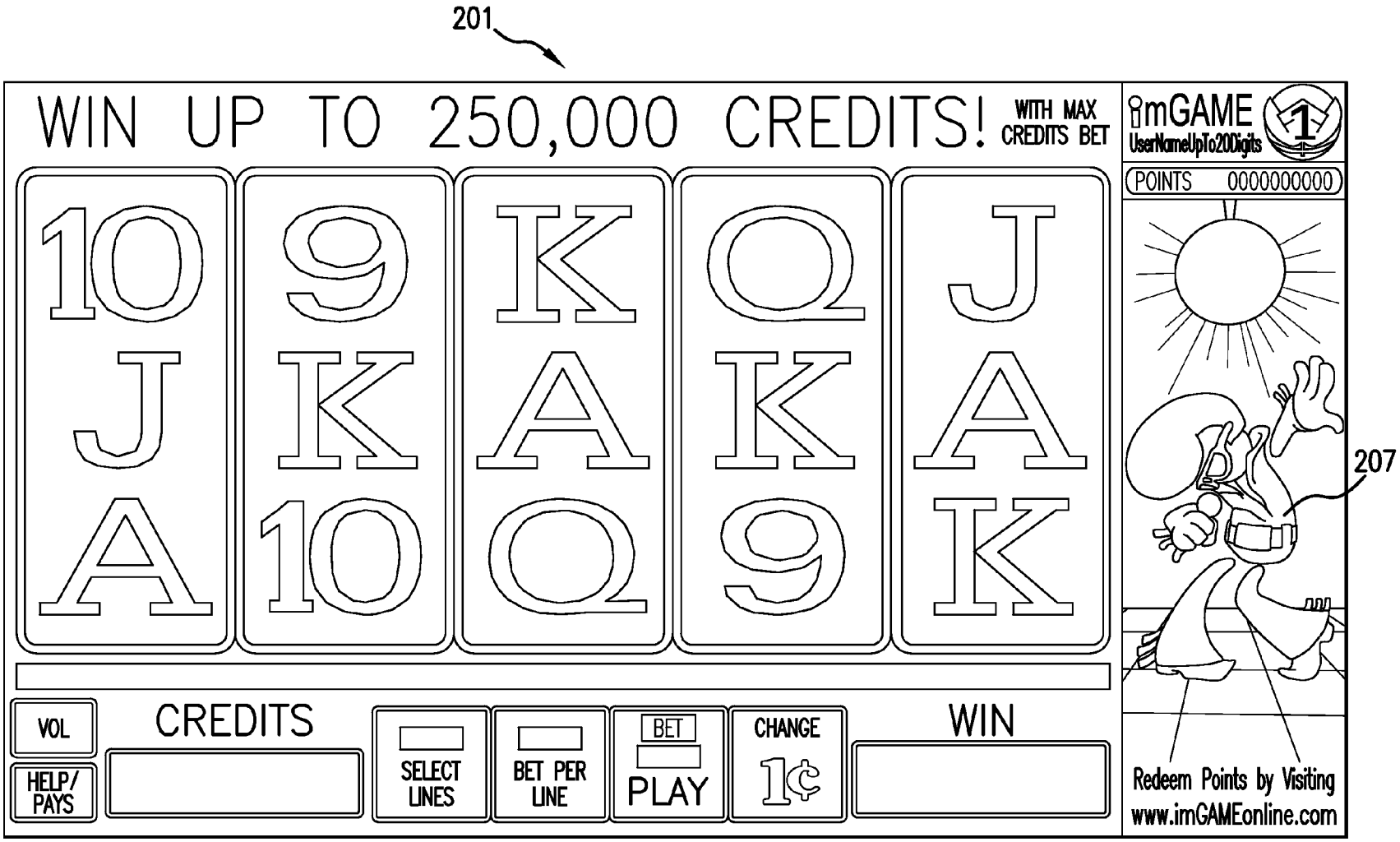
FIG. 2 is a celebration mode screenshot of a wagering game with a customizable player avatar in accordance with an example embodiment of the present invention.

Referring to FIG. 2, celebratory screenshot 201 is shown including a wagering game and customized player avatar 207 in celebration mode in accordance with an example embodiment of the present invention. Customized player avatar 207 celebration may include audio and visual effects, such as singing 'You are the champion of the world' and spinning overhead globe with strobe light effects. By further example, in the case of an Elvis customized player avatar such as is shown, the avatar might sing an Elvis selection with Elvis voice, such as 'You ain't nothing but a hounddog'.

Figure 3:
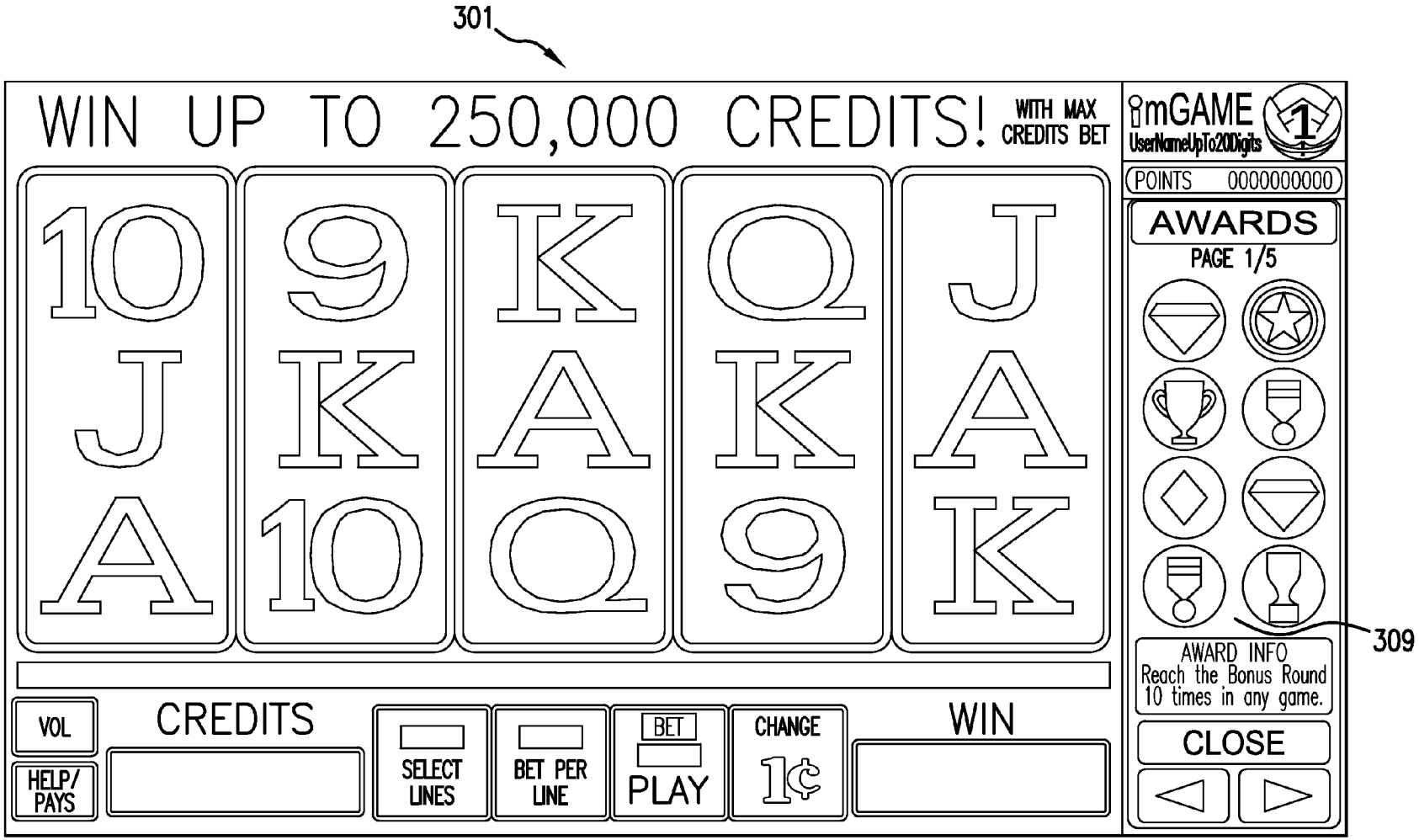
FIG. 3 is a screenshot of a wagering game with a player trophy wall in accordance with an example embodiment of the present invention.

Referring to FIG. 3, trophy wall screenshot 301 is shown including a wagering game and player trophy wall 309 in accordance with an example embodiment of the present invention. The trophies and medals may be awards that are earned by the player through play and achievement of various milestones or which may be purchased by the player using imGame (or avatar) points or virtual (or avatar) currency.

Figure 4:
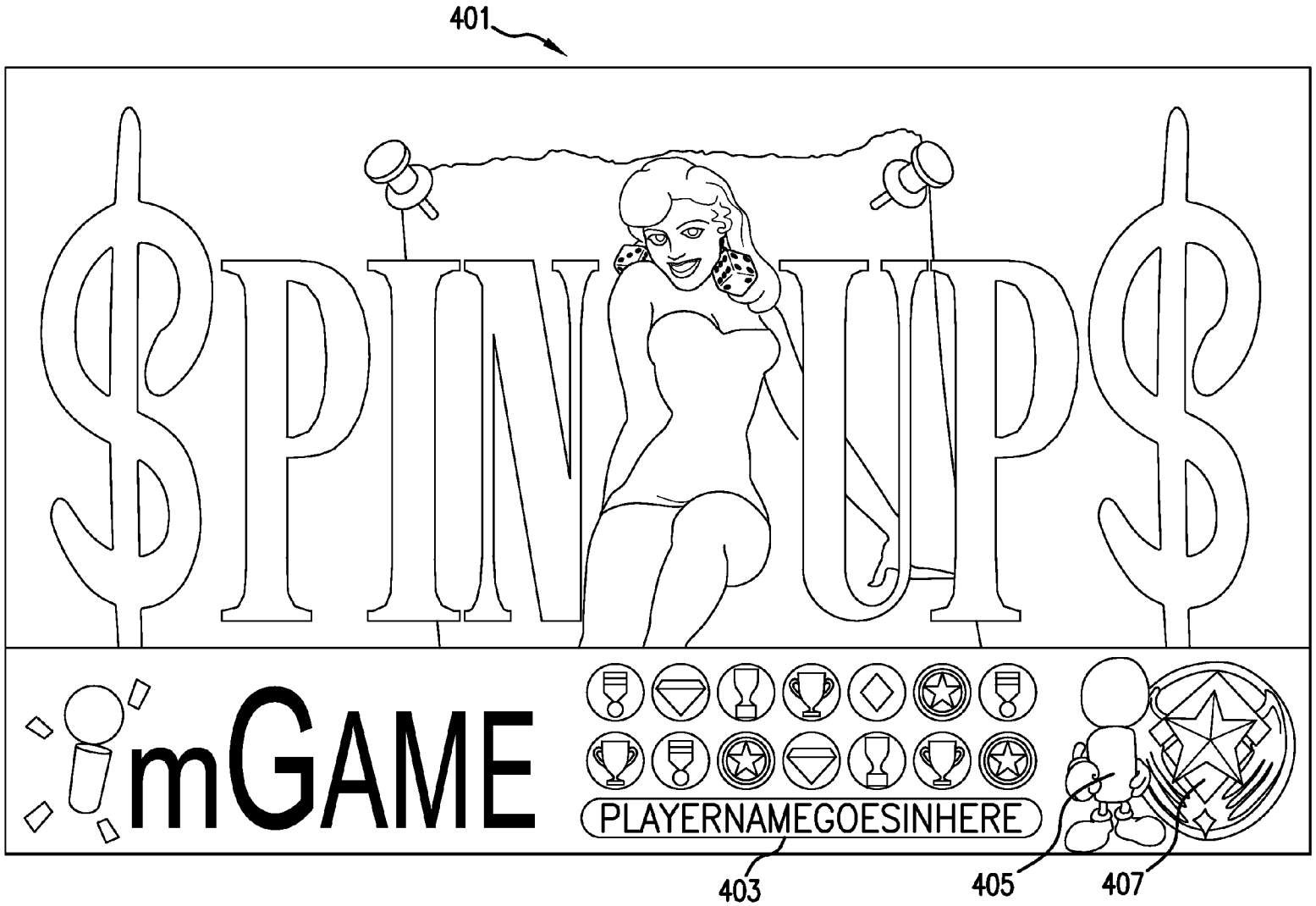
FIG. 4 is a screenshot of a feature game associated with a wagering game with a customizable player avatar and trophy wall in accordance with an example embodiment of the present invention.

Referring to FIG. 4, imGame feature game screenshot 401 is shown including a pinup model entertainment game ('$PIN UP$'), player trophy wall 403, and customized player avatar 405 in accordance with an example embodiment of the present invention. Feature game screenshot 401 may be triggered by the player achieving a special level or threshold associated with the imGame points or some other event triggered through imGame. The $PIN UP$ feature game may present the player with a special show on a portion of a primary or imGame display area or on a display area separate from the primary game, such as an overhead or top box display. For example, the pinup girl may make an audio-visual presentation of newly earned medal or trophy 407 to player avatar 405 and newly earned medal or trophy 407 may then appear on player trophy wall 403.

The $PIN UP$ game may provide a selectable option for a player to choose particular 2D or 3D images to be the player's customized pin up presenters; for example the player may be able to select from a set of male or female models or personalities, pets or mascots. The pets or mascots may be animated with human speech and characteristics, in order to make the presentation to player avatar 405. In the case of personalities, there may be a choice of singers (such as rock, R&B, heavy metal, classical, country, honky tonk, modern, etc.), actors, caricatures, etc., or types thereof, each of which may briefly perform according to their characteristic and make a presentation.

In one or more embodiments, the selectable sets of models, personalities, pets, or mascots may each include a sub-set of images whereby the subset of images may be the same model, pet, or mascot in different attire or settings similar to a calendar and a different one of the images of the subset appear to make each separate medal or trophy presentation. In one or more embodiments, each subset may include different models in similar attire, such as bathing suits, lingerie, night club clothing, sports clothing, etc. with venues that may vary as well. In the case of pets, each subset may include different breeds of dogs or the same dog in different settings. In the case of mascots, an animal mascot subset may include different animals or the same animal mascot in different settings or attire. In the case of non-animal mascots, the subset may include the same mascot in different settings or different mascot images or image variations of the mascot (such as a bar of gold), each of which may be animate-able in order to make the presentation in audio-visually.

In another example, a player may upload a picture, such as one of themself, which may be caricatured through imaging software into the player's customizable avatar.

Figure 5C:
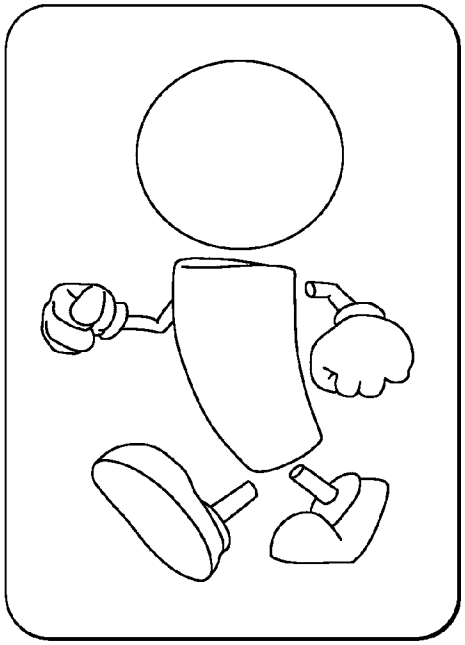
FIG. 5A, 5B, 5C illustrate several default customizable player avatars associated with a wagering game in accordance with an example embodiment of the present invention.
Figure 5B:
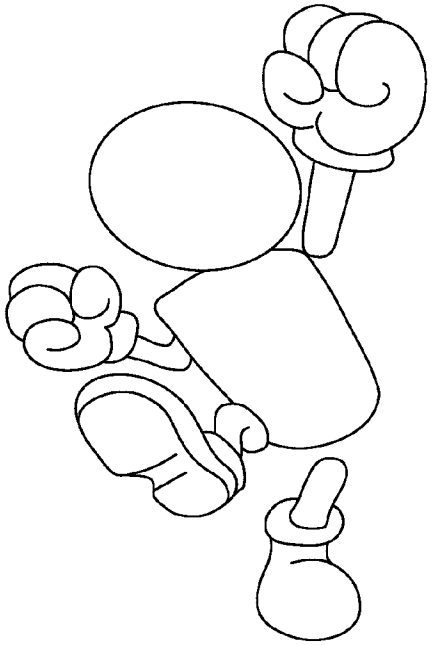
Figure 5A:
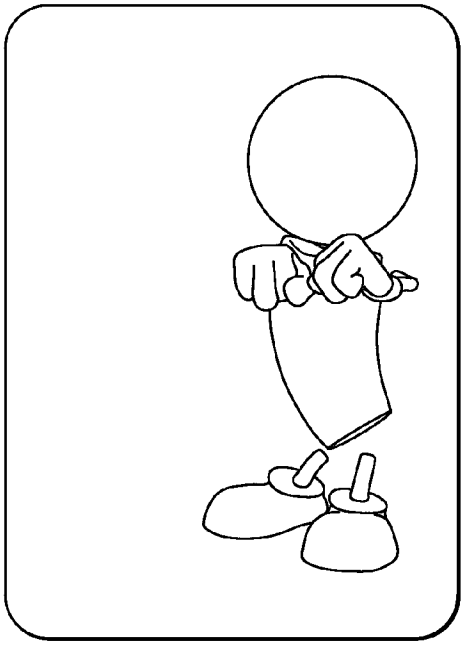

FIG. 5A, 5B, 5C illustrate several default customizable player avatars associated with a wagering game in accordance with an example embodiment of the present invention.

Figure 6B:
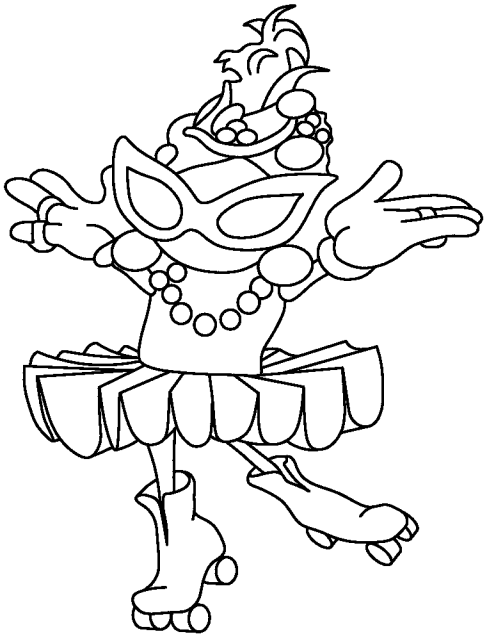
FIG. 6A, 6B illustrate a default customizable player avatar and a customized player avatar, respectively, associated with a wagering game in accordance with an example embodiment of the present invention.
Figure 6A:
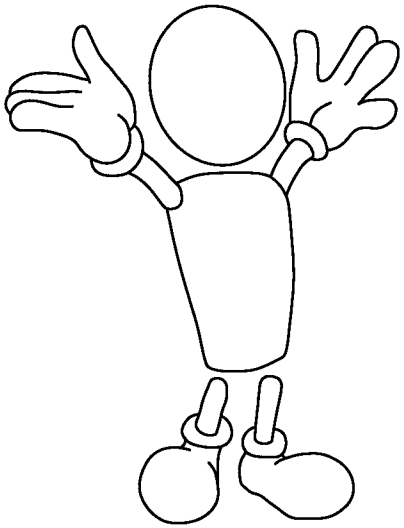

FIG. 6A, 6B illustrate a default customizable player avatar and a customized player avatar, respectively, associated with a wagering game in accordance with an example embodiment of the present invention.

Figure 7A:
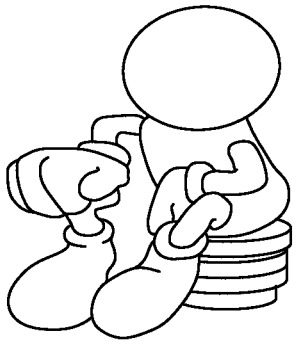
FIG. 7A, 7B illustrate a default customizable player avatar and a customized player avatar, respectively, associated with a wagering game in accordance with an example embodiment of the present invention.
Figure 7B:
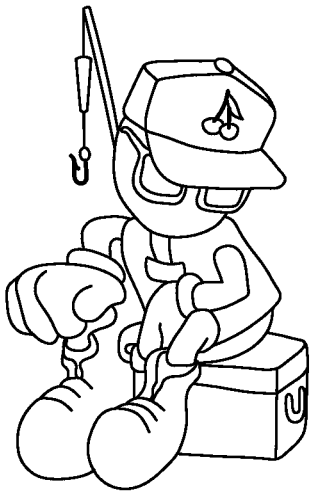
Figure 8A:
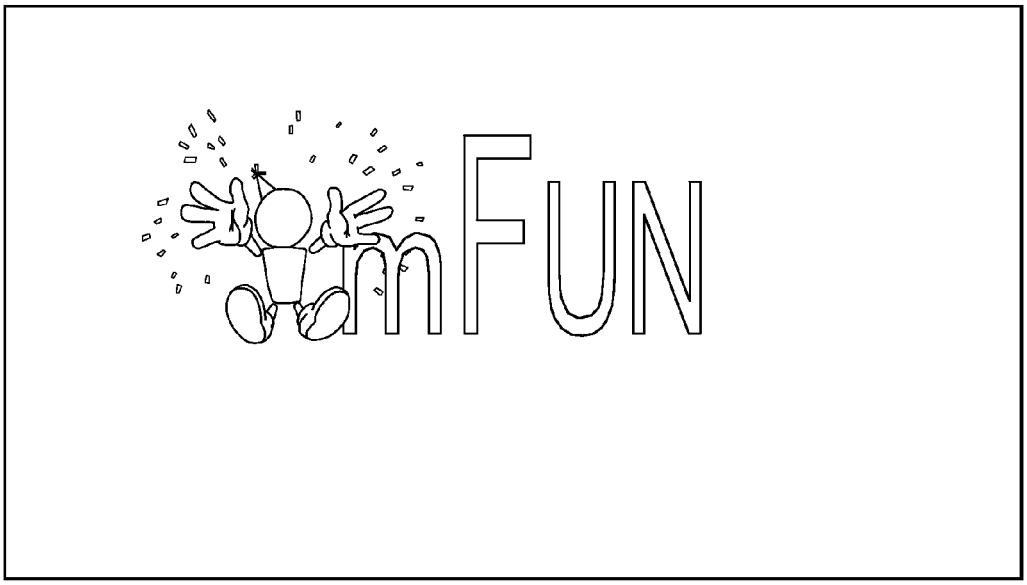
FIG. 8A, 8B, 8C, 8D, 8E, 8F illustrate several secondary display screenshots with respective customizable player avatars and attributes associated with a wagering game in accordance with an example embodiment of the present invention.
Figure 8B:
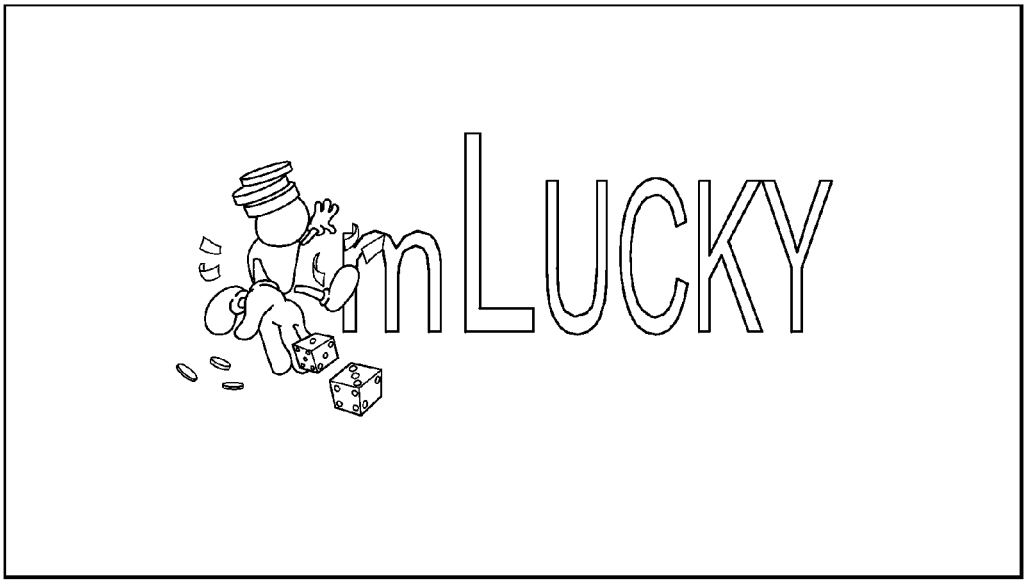
Figure 8C:
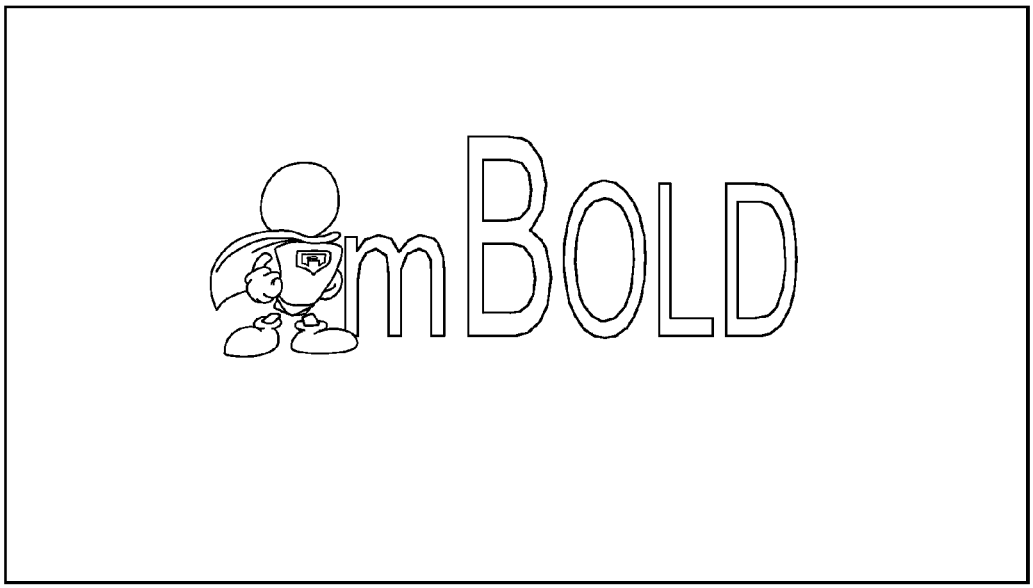
Figure 8D:
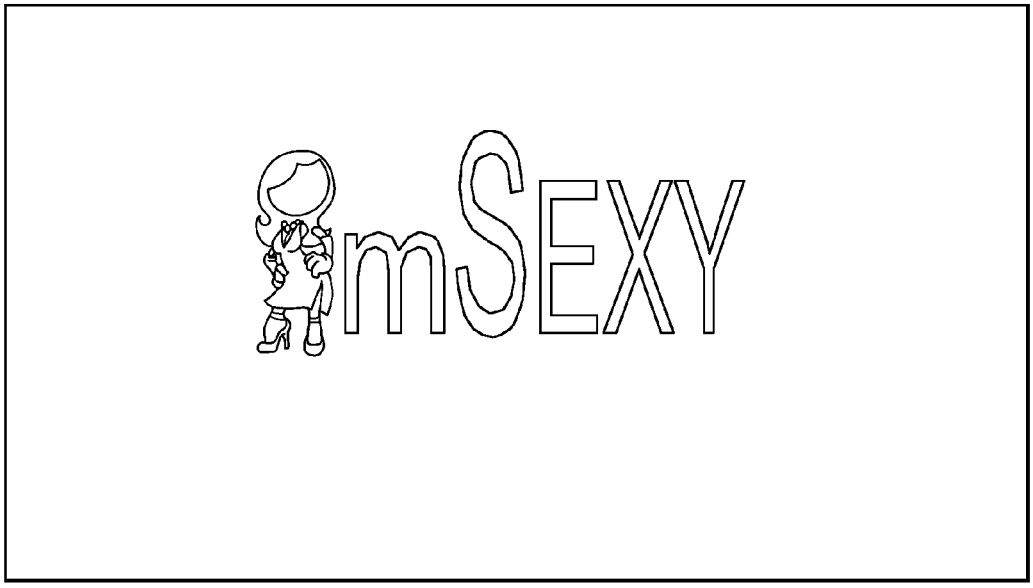
Figure 8E:
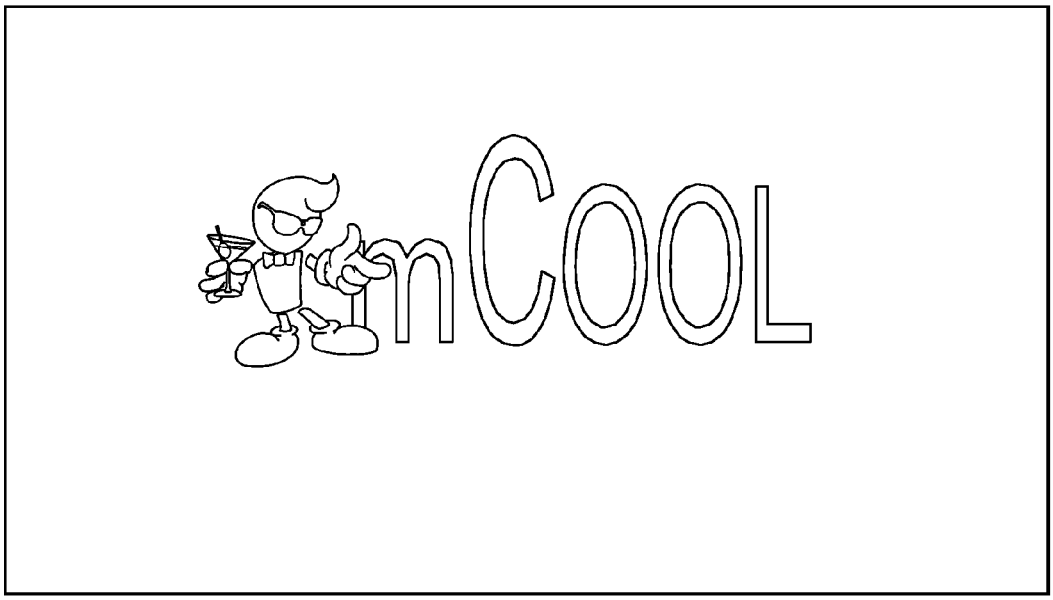
Figure 8F:
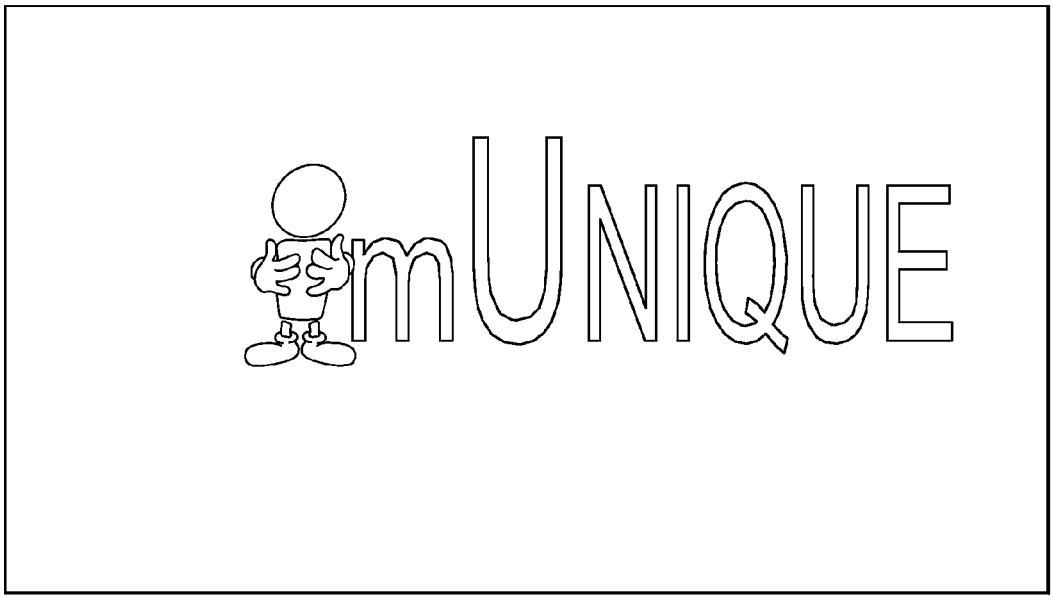

FIG. 7A, 7B illustrate a default customizable player avatar and a customized player avatar, respectively, associated with a wagering game in accordance with an example embodiment of the present invention.

FIG. 8A, 8B, 8C, 8D, 8E, 8F illustrate several secondary display screenshots with respective customizable player avatars and attributes associated with a wagering game in accordance with an example embodiment of the present invention.

Figure 9:
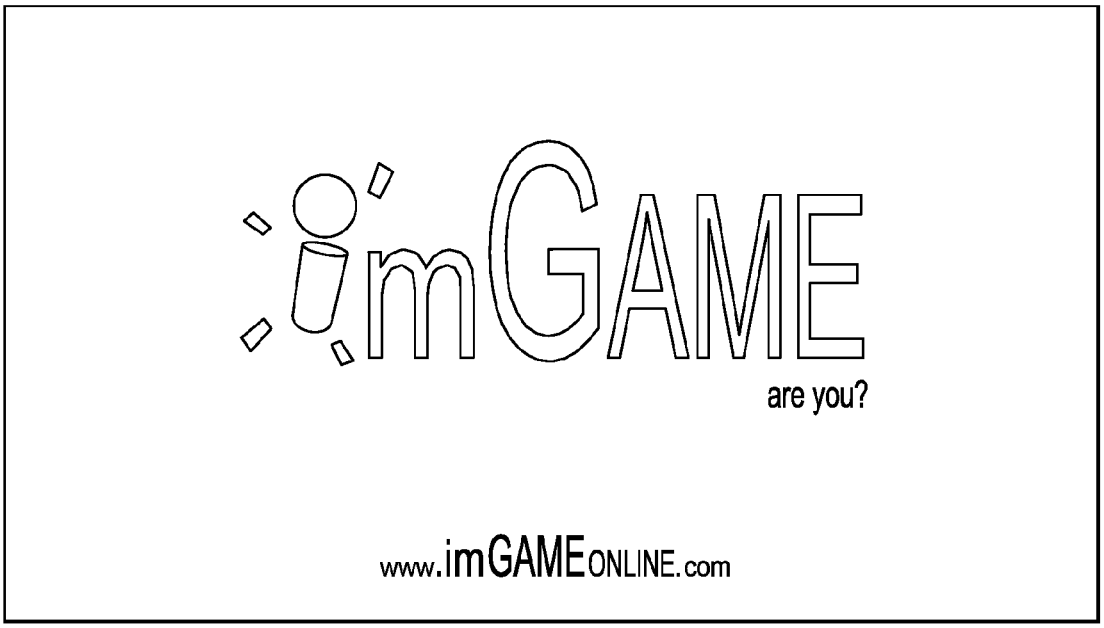
FIG. 9 illustrates a secondary display attract mode screenshot with respective customizable player avatar and attribute associated with a wagering game in accordance with an example embodiment of the present invention.

FIG. 9 illustrates a secondary display attract mode screenshot with respective customizable player avatar and attribute associated with a wagering game in accordance with an example embodiment of the present invention.

Figure 10:
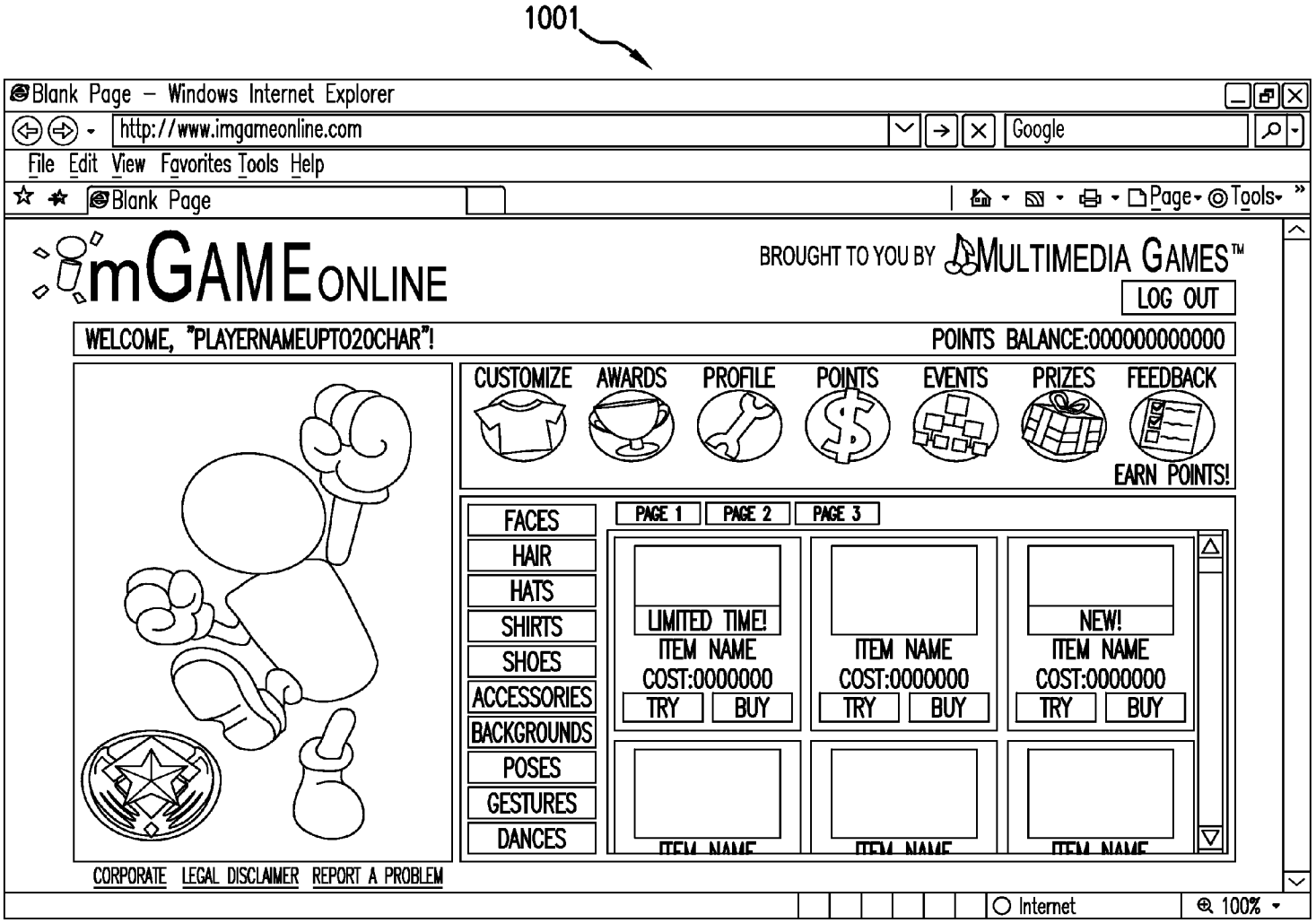
FIG. 10 illustrates a webpage enabling a player to customize the player's avatar associated with a wagering game in accordance with an example embodiment of the present invention.

Referring to FIG. 10, webpage 1001 is shown for redeeming imGame points, earning or purchasing additional points, customizing the player's avatar, and so forth, in accordance with an example embodiment of the present invention. An example website may be www.imGAMEonline.com which may be accessed by a player online through a web-connected device, such as a PC. After logging in, the player's points and current state of the player's avatar may be displayed and the player can transact business or engage in activities at the website including redeeming imGame points and customizing the player's avatar. The player may also spend imGame (or avatar) points by purchasing various paraphernalia or by participating in contests or games offered through the website. In some instances, the player may use the imGame points to purchase or exchange for virtual (or avatar) currency, which may be used to purchase customizations for the player's avatar and avatar panel. Additionally, the player may earn additional imGame points or virtual currency by participating in surveys, engaging in micro-transactions (purchasing imGame points), using affiliate programs, services, or products, or making referrals. Additionally, the player may purchase imGame points or virtual currency directly through credit cards on through an online payment system, such as PayPal.

In some instances, the player website may have an option available for a player to gift imGame points or virtual currency, or virtual gifts, such as a rose, bouquet of flowers, or box of chocolates, to another player or imGame website user. The player may further be able to personalize a card which may open when the recipient logs onto the website or a networked gaming device with an avatar program module. The recipient of the gift may have the option to accept or refuse the gift; and in the case of a gift of points or currency, the recipient may then use the points or currency to conduct one or more transactions. In the case where a gift has been sent, when the receiving player log onto the website or at a networked gaming device with an avatar program module, the receiving player may receive a presentation notifying the player that the player has received a gift of points or currency and that the player's cumulative total has been increased accordingly, or if the player has received a gift item and a card, these may be presented through an avatar presentation, such as a presentation by the gifting player's avatar to the receiving player's avatar.

Some of the customizable items or features that may be purchased by the player include faces, hair, hats, shirts, shoes, accessories, backgrounds, poses, gestures, and dances, each of which may be selectable using a menu such as shown on webpage 1001. Additionally, in some instances, the player may have the option to change the player avatar to a completely different character, shape, or item. In further instances, the player may add customizations such as a girlfriend or wife, children, or one or more pets for the player's avatar. In other instances, the player may choose to collect collectibles, such as virtual stuffed animals that may be used to customize a player's avatar shelf or wall.

Figure 11:
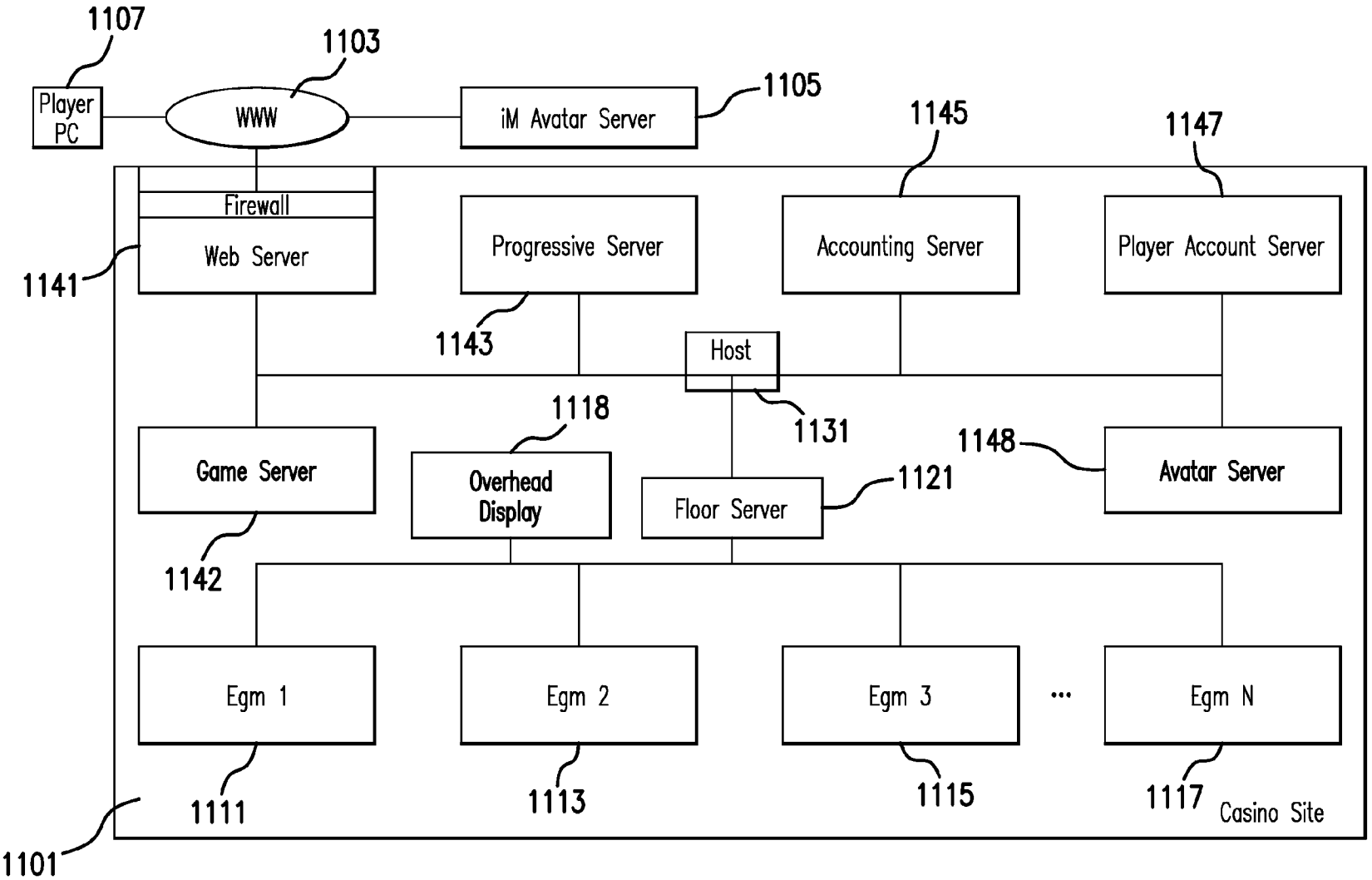
FIG. 11 illustrates a secure networked gaming system connected to a public web network including an Avatar server connectable by a player through a network connectable device, such as a Player Personal Computer (PC), to customize the player's avatar in accordance with an example embodiment of the present invention.

FIG. 11 illustrates secure networked gaming system 1101 associated with one or more gaming facilities and connected to a public web network, such as worldwide web (WWW) network 1103 including Avatar server 1105 connectable by a player through a network connectable device, such as Player Personal Computer (PC) 1107, to customize the player's customizable avatar in accordance with an example embodiment of the present invention. Player customizations to their player avatar or panel may be instanced through opportunities offered at one or more gaming devices during one or more gaming sessions, or by logging onto the imGame (avatar) website through a network connectable device and using the imGame points or virtual currency to purchase the customizations.

As shown, Egm 1 through Egm N 1111, 1113, 1115, 1117, respectively, and overhead display 1118 are network connected through Floor Server 1121 to Host Server 1131 which in turn connects to Web Server 1141 which may provide a WWW connection of networked gaming system 1101 through a firewall and enable updating of player's persistent imGame and player avatar data and providing of the persistent data to the player at one or more networked gaming devices connected with the facility. In one or more instances, each or selected networked gaming devices include an avatar program module which may utilize persistent player avatar data together with a processor to render the customized player avatar and panel on a display location. In other instances, one or more of the gaming devices may include a player interface and display controller for rendering images from Gaming Server 1142 and Avatar Server 1148 to present the transmitted server-based wagering game and avatar presentations. As referenced previously, in predetermined instances, a celebration presentation may be transmitted to overhead display 1118 and/or to other gaming devices, such as when a player wins a major jackpot.

Networked gaming system 1101 may by example include Game Server 1142 which may provide server-based games to network connected gaming devices such as Egm 1 through Egm N; Progressive Server 1143 which may accumulate progressive awards by receiving a percentage of the wagers from eligible gaming devices or by receiving funding from marketing or casino funds and provide progressive awards to winning gaming devices upon a progressive event, such as a progressive jackpot game outcome or other triggering event such as a random or pseudo-random win determination at a networked gaming device or server; Accounting Server 1145 which may receive gaming data from each of the networked gaming devices; Player Account Server 1147 which may maintain player account records and persistent data such as accumulated player points; and Avatar Server 1148 which may update and store player avatar persistent data and provide the data to a networked gaming device upon player login. While various servers have been shown separately, they may be combined or split into additional servers having additional capabilities.

For example, Player Account Server 1147 as shown may include Biometric processing and database for identifying players through physical characteristics. Alternatively, one or more separate servers may be utilized as is shown in more detail in Networked Gaming System including Anonymous Biometric Identification, U.S. patent application Ser. No. 12/269,712, filed Nov. 12, 2008 which is hereby incorporated in entirety by reference. In another example, Accounting Server 1145 as shown may include game monitoring and casino management or optimizing software using current and historical data to modify floor patterns, such as IGT's Mariposa System or as described in System and Method for Casino Management, U.S. patent application Ser. No. 09/981,653, filed Oct. 18, 2001 which is hereby incorporated in entirety by reference. Such data may further be refined to record and analyze each player's preferences historically and to offer selections, services, and options that are player specific. The biometric data may be used both for player identification, as well as to gauge player mood and attitude based on changes in the player's image, temperature, pulse, audible responses, etc. depending upon the biometric receiving devices available, such as conventional or heat-sensitive cameras, temperature or pulse sensitive player interface keys or pads, etc. These mood or attitude swings may then be used to adjust the displayed attitude or mood of the player's customized avatar, either correspondingly, encouragingly, sympathetically, or in some other empathic manner.

In one example, the options at a gaming machine for an identified player may be varied by utilizing biometric and player history information to present different avatar panel selectable options. For example, an elderly female patron may have different preferences than a younger male patron and those preferences may have been identified through analysis of the historical game and options selections by each of the players through Accounting Server 1145. From that analysis, game options and avatar panel options may be modified for the specific player. For example, the young male patron may prefer the female pinup models for presenting awards and medals; while the elderly female patron may prefer Frank Sinatra for presenting awards and medals. Additionally, customizing options that may be offered for the player's customizable avatar may be player specific based on the player's previous selections. As a further example, one player may historically close the avatar panel; thus, when the player inserts the player's patron card, Player Account Server 1147 may transmit data to the gaming machine that closes the avatar panel automatically and leaves a selectable icon on the display for the player to open the avatar panel. For example, the selectable icon may appear on the player interface display, such as may be provided through a Bally iView player interface unit.

In another alternative, players' overall historical avatar selections may be collected and analyzed using software such as that used in the casino management and optimizing software to provide selections that are shown as being generally preferred and eliminating selections or options which are generally not preferred. Such options and selections may be retained on avatar server 1105 to meet the preferences of the smaller percentage of players.

Referring again to FIG. 10, a player initiating play at one of the gaming machines may initially see an attract mode display such as depicted in one or more of FIG. 1-9 or renditions thereof. Once a player is identified as by insertion of a patron card, selected of the player's information may be transmitted to the gaming machine and a player interface unit controller may cause a display to show the player's playing points and to personalize a greeting to the player, such as "Hi, Bob, glad to have you back'. Simultaneously, the player's avatar account may be accessed, such as if Player Account Server 1147 stores a player's related avatar account identification information. Alternatively, the player may separately login to the player's avatar account, such as through fields presented to the player on avatar panel 105 (FIG. 1) when the player selects the "LOG IN" icon. Upon identification, the player's avatar account information may be directly accessed from Avatar server 1105 through Web Server 1141 over WWW 1103; in which case, Avatar server 1105 may be automatically updated after or during each player gaming session through one or more data transmissions from the player's gaming machine and over the network through Floor Server 1121, Host Server 1131, and Web Server 1141, and, across WWW 1103 to Avatar Server 1105. In the event of inter-gaming session data transfers, Avatar Server may including programming configured to monitor player activity and to initiate offers, options, or selections to the player which may be displayed on avatar panel 105 at the gaming machine through the network connection.

Alternatively, Player Account Server 1147 may include an avatar account database that may be accessed for transmitting avatar account information to the player's gaming machine and may be automatically updated during or after each player gaming session. In such case, the player avatar account information may be linked to the player's patron card for automatic access of both the player's patron account information associated with a specific casino or family of casinos, and, the player's avatar account information associated with avatar server 1105 or a mirrored database, such as may be connected to Player Account Server 1147 or through Host Server 1131.

Although, the avatar player customizations may be preferred by the player and avatar service provider to be universally available at any networked gaming facility with gaming machines connected to receive player avatar information; an alternative embodiment may limit player avatar accounts and information to specific gaming facilities, such as Harrahs, MGM, or Boyd gaming operator facilities.

In one or more embodiments, a casino operator may be able to program player rewards through a user console connected to host server 1131, such as an avatar loyalty point award that may be awarded when a player with a player avatar account initiates play at a gaming machine at one of the operator's facilities and accesses the player's avatar account. Such awards may be unilaterally or bilaterally initiated by the casino operator or the avatar service provider. The awards may not be limited to avatar points. The awards may be customization offers or awards provided to the player; for example, upon each subsequent gaming session following a gaming session where the player wagered a pre-determined threshold amount, such as $100. In the event, such awards are unilaterally provided by the operator, a replenish-able marketing account may be established by the operator with the avatar service provider to provide the additional awards to its players. In other instances, an operator (such as casino management) may use the user console to program additional avatar-related awards, such as by providing opportunities or competitions to accumulate additional one time point bonuses during timed challenges on a daily, weekly, or one-time basis. For example, the operator may program the system to provide that if a player has an outcome of five of a kind, the avatar point or currency award may be doubled, tripled, or multiplied by some other factor; or, additional avatar points or currency may be provided when one or more free spins are triggered on a wagering game, such as Jambalaya jackpot.

Following play at gaming facilities, the player may elect to utilize player pc 1107 to access avatar server 1105 over WWW network 1103, access the player's avatar account by entering the player's login information, customize the player's avatar and conduct other business or entertainment activities as discussed above.

Figure 12A:
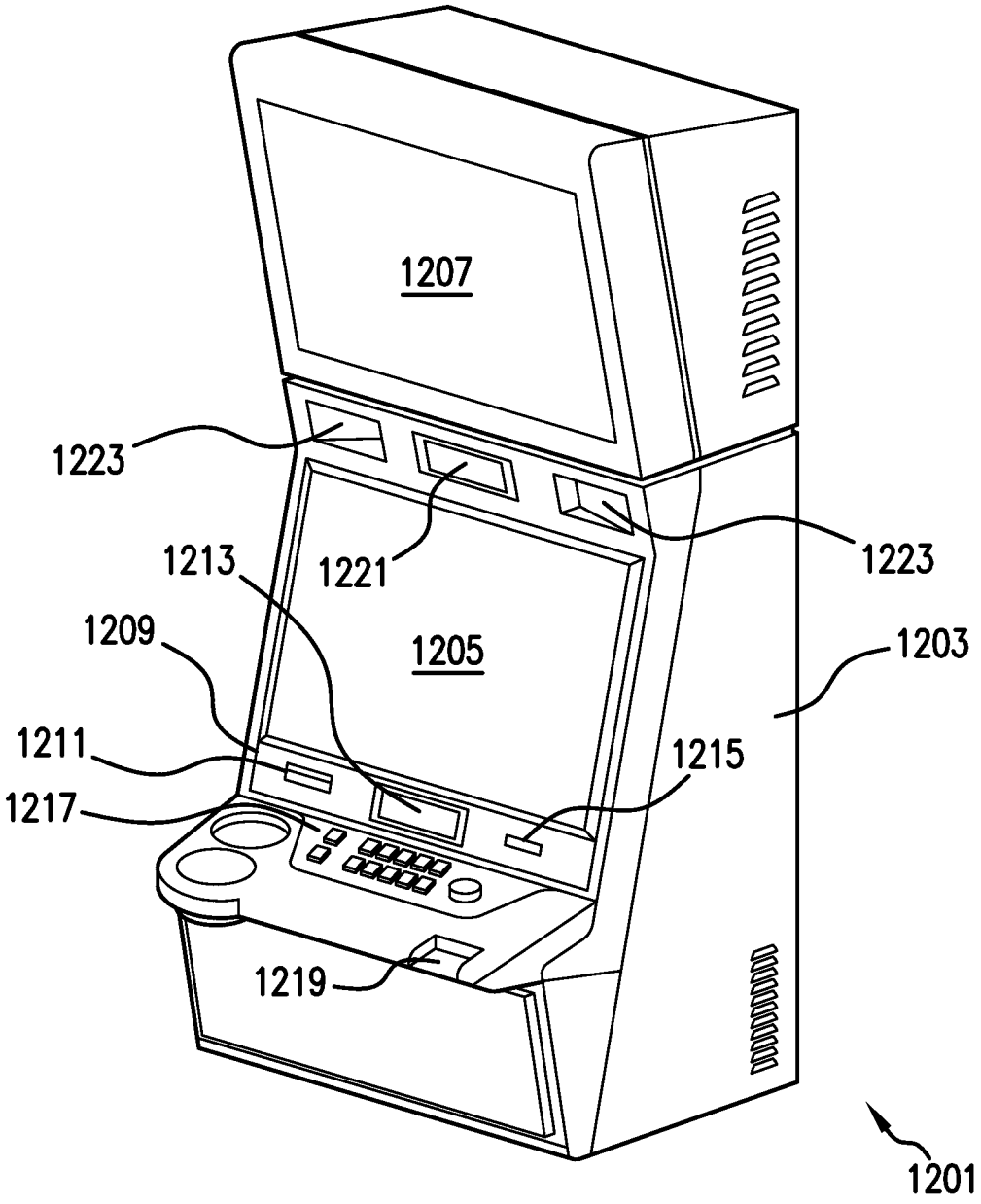
FIG. 12A, 12B illustrate respective gaming machines operable to present a wagering game and customizable player avatar in accordance with an example embodiment of the present invention.
Figure 12B:
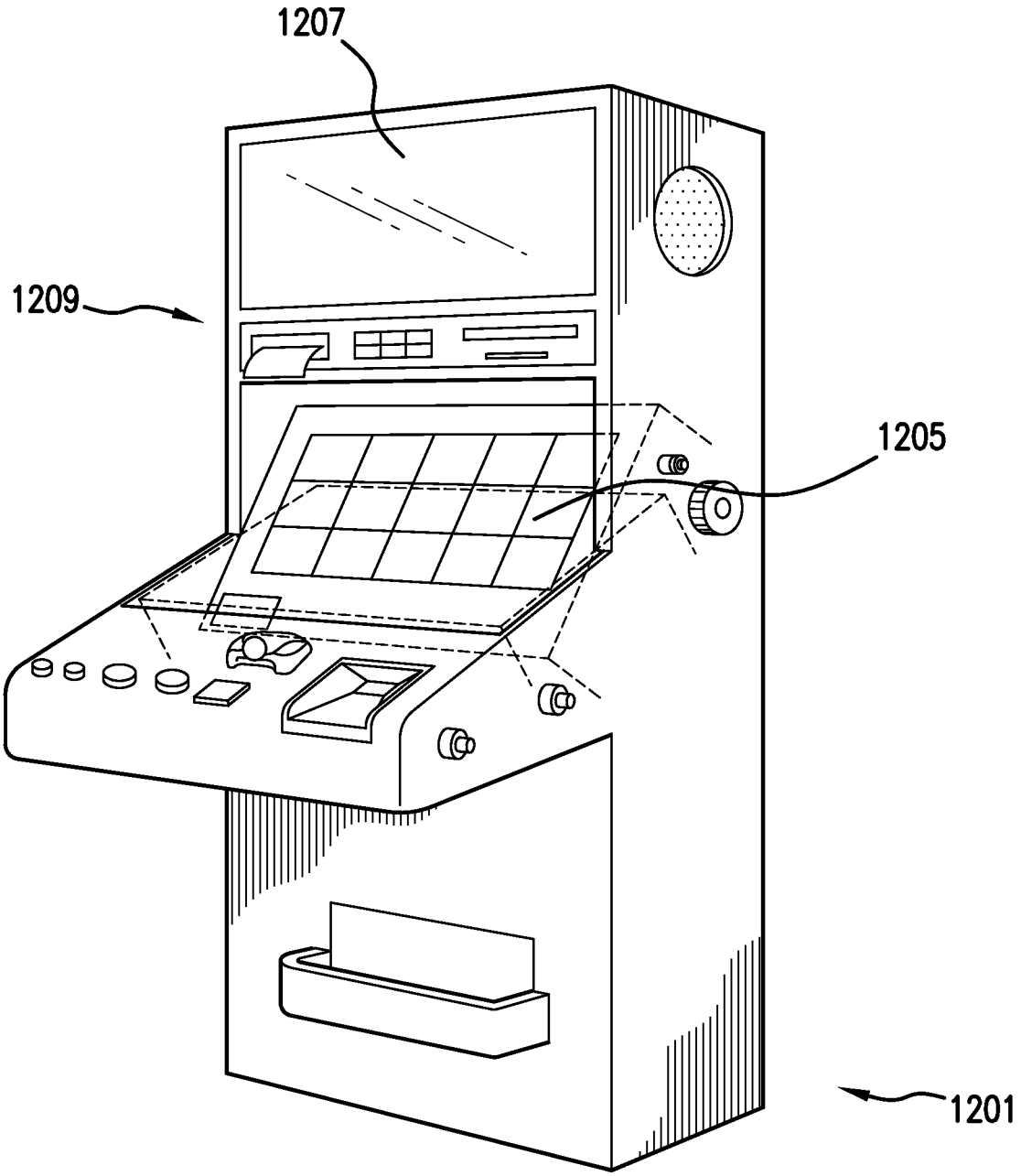

Referring to FIG. 12A, 12B, gaming machines 1201, 1251 are shown which may be operably configured to present a wagering game and customizable player avatar in accordance with example embodiments of the present invention.

Referring to FIG. 12A, gaming machine 1201 includes cabinet 1203, primary game display 1205, secondary display 1207, and player interface unit 1209 which includes player card reader 1211, secondary display 1213, voucher printer 1215, and which may include or incorporate the functionality of one or more of player-activated button deck 1217, bill/voucher and/or credit card acceptor 1219, secondary display 1221, and speakers 1223.

Cabinet 1203 is a self-standing unit that is generally rectangular in shape and may be manufactured with reinforced steel or other rigid materials which are resistant to tampering and vandalism. Conventionally, cabinet housing 1203 houses a game processor (such as an Intel or AMD microprocessor) and printed circuit board with one or more associated memory devices storing one or more game programs and data, one or more peripheral processors (microprocessors, controllers, and/or digital signal processors) and circuit boards with associated memory devices storing associated programming executable by the associated processor.

The game processor may be configured to receive signals from player-activated buttons 1207, operate the games by executing game software, and transmit signals to the respective peripherals including displays 1205, 1209, 1211 and speakers 1213 to present one or more wagering games to the player including the avatar panel and associated player avatar. The wagering games may include a primary game and one or more secondary games, which may be mechanical or video reel-based, such as that shown in FIG. 1 et seq., bingo-based, pachinko-based, card-based (such as poker, blackjack, war, etc.), wheel-based (such as roulette), dice-based (such as craps), or based upon any other type of wagering game.

The outcome of the wagering games may be determined by the game processor using a random number generator or pseudo-random number generator (RNG) program. For example, the game processor may use a random number generator to determine the terminating position of each reel of a reel-based game and spin the reels to present that outcome. Alternatively, the award outcome may be determined after running the RNG and the award outcome matched with a game presentation of some other type of wagering game, such as bingo, a card game, a wheel game, etc. In another example approach, the game processor may randomly select from a finite pool of possible outcomes of bingo or some other game; and after determining the outcome presenting the same or a different type of game with the same outcome to the player. Alternatively, a selection may be made by the processor from a pool of possible award outcomes which may then be correlated with an outcome of a game to be presented. In an example finite pool, once an outcome has been selected from the pool, that outcome is removed from the pool so that subsequent game play selects from the modified pool.

Gaming machine 1201 may be implemented in many different styles and embodiments which may provide a player access for playing one or more games. For example, gaming machine 1201 may comprise an upright (example shown in FIG. 12A), slant-top (example shown in FIG. 12B), bar-top, or table-top cabinet, and, be stand-alone or networked. Alternatively, gaming machine 1201 may be implemented through a personal computer (PC), laptop PC, or handheld device, such as a wireless tablet (e.g. Apple iPhone) or data device or phone (e.g. Apple iPhone or iPad, Blackberry cellular phone).

In one or more embodiments, the games presented may be executed on a server, such as Host server or a separate server, configured to execute server-based game programs, transmit graphics and related data for presentation at the smaller gaming device, receive player inputs, such as wager, lines, or selections related to the avatar panel &/or player's customized avatar, and respond to the player inputs. In various embodiments, gaming machine 1201 may both execute one or more gaming programs internally and display server-executed games. The server-executed games may include the avatar customization and interactivity programming, such as discussed above. In the case of server-executed games, the presentation of the game may be controlled or manipulated through the game processor which may receive and use server-based gaming data to control display content, such as displaying the customized player avatar and avatar panel in a selected area and displaying the primary or wagering game in another selected area. Alternatively, portions of the avatar display content may be overlaid over portions of the primary game display as may be rendered on either a single display, for example using three-dimensional graphics programming, or overlaid displays where content may be rendered to each display while providing a transmissive or transparent display characteristic to the overlaying display according to the game programming. In other embodiments, the content or portions of one or more displays may be controlled through a display manager, such as Bally's iView DM, wherein the field associated with the primary game on the primary display or images on one or more other displays may be reduced to accommodate insertion of another field to present the avatar panel and content thereto.

Additionally, each display device referenced herein may include any suitable display device including a cathode ray tube, LCD (liquid crystal display), plasma display, LED (light emitting diode) or OLED (organic light emitting diode) display, FOLED (flexible OLED) or any other useable display device. The displays may be touch panel, such that the player interface unit or a portion thereof, may be included as part of the display panel. The presentation on the display may also be orientation specific, such that when a display is turned from a landscape orientation to a portrait orientation, the presentation may shift from landscape mode to portrait mode to accommodate the vision of the player and the height and width of the display orientation. Commercial examples of this type of orientation shift effect are found in the Apple iPhone and iPad. In one or more embodiments, one or more of the displays may be touch sensitive and enable a player to make selections and interact with the games or features by touching the display. In such instances, the player may be able to drag and drop selected fields, such as by moving the avatar panel from one location to another. In such instances, the player may increase or decrease the size of the field by selecting a corner or side of the panel and dragging it in the desired direction. The player may overlay portions of one field, such as the avatar panel, over another, such as the wagering game panel; alternatively, as the player drags the avatar panel to one location, the wagering game panel may automatically adjust to a location corresponding to the remaining area of the display. For example, if the player drags the avatar panel to the lower portion of the display and resizes, the wagering game panel may automatically re-locate and size to fit the upper portion of the display. The wagering game panel may have a minimum size permitted, but the avatar panel may be closed entirely by a player; alternatively, the avatar panel may be selectable to increase the panel to fill the display for a limited time, such as to make a customization selection and to customize the player avatar.

One approach for providing interactivity of the player avatar with the player and the game, is by enabling the game processor to execute player avatar software together with data related to the state of the gaming device and outcome of each game play, to generate the displayed player avatar image together with motion, emotion, vocal, and background audio/visual effects. For example, responsive to the state, the player avatar software may operate to generate player avatar emotions, such as anticipation or encouragement while the reels are spinning, commiseration when the outcome is a loss, happiness when the outcome is a win, and concern when the player's credits (funds) are running low. Additionally, the player avatar may become excited when additional credits (funds) are added to the gaming device, say 'good-bye' when the player cashes out, etc.

The player avatar software may have thresholds that when reached or achieved during play may cause the displayed player avatar and background A/V to be generated commensurate with the threshold or achievement. For example, thresholds may be set for a one, ten, fifty, or one hundred credit win, such that when the win occurs in the underlying wagering game, the player avatar's celebration increases with each threshold. Similarly, as a player's losses increase, the player avatar's may commiseration or encouragement may increase as thresholds are achieved and at some threshold point, the player avatar may say 'want to take a break?' as an approach to introduce a suggestion for responsible gaming that may be fixed at a threshold in the software or modifiable as part of the player avatar data transmission to the gaming device or machine. As discussed above, apart from a basic set of avatar characteristics, some or all of various motions, emotions, vocal, characteristics, and background A/V may be acquired by a player by game play, redemption of avatar points or purchases or participation in other activities; and, the base or generic avatar may have limited functionality or interactivity.

In one or more embodiments, the player avatar panel may be displayed together with the primary wagering game on the primary display; for example, as shown in FIG. 1 et seq. In other embodiments, the player avatar panel may be displayed on one of the secondary displays. More than one player avatar image or panel may be displayed on one or more displays. Additionally, the player avatar panel may be generated from a separate board and processor; for example, player interface unit, such as a Bally iView or iView DM (Display Manager) player interface unit.

Those skilled in the art will readily recognize various modifications and changes that may be made to the claimed invention without following the example embodiments and applications illustrated and described herein, and without departing from the true spirit and scope of the claimed invention, which is set forth in the following claims.

We claim:

1. A wagering game system including:

(a) a player interface system enabling a player to initiate a wager for a play in a wagering game;

(b) one or more display devices; and (c) one or more processors configured to:

(i) cause at least one of the one or more display devices to display a player avatar presentation including at least one player avatar and also including an avatar point value in an avatar point display area of the player avatar presentation, (ii) cause the player avatar presentation to include a customization for the player avatar responsive to a redemption of avatar points from the avatar point value, (iii) cause the one or more display devices to display a game presentation showing an outcome for the play in the wagering game, a win value for the outcome, and a remaining credit value for the player, the game presentation being displayed concurrently with the player avatar presentation, and the remaining credit value and win value being separate from the avatar point value, and (iv) cause the player avatar to present an animation responsive to the outcome, the presented animation being selected from at least two different animations wherein each different animation corresponds to a particular outcome type in the game.

2. The wagering game system of claim 1 wherein the game presentation and player avatar presentation are displayed concurrently in separate distinct windows on one of the one or more display devices.

3. The wagering game system of claim 1 wherein the one or more processors are further configured to cause the area of the avatar presentation to change to an avatar trophy wall presentation including at least one avatar award symbol for an award which has been obtained for the player avatar.

4. The wagering game system of claim 1 wherein the one or more processors are further configured to cause one of the one or more display devices to display an avatar award ceremony including an animation of a pin up presenter presenting the player avatar with an avatar award.

5. The wagering game system of claim 4 wherein the pin up presenter is selected from a number of different player-selectable pin up presenter options.

6. The wagering game system of claim 1 further including an overhead display device associated with two or more separate gaming machines, and wherein the one or more processors are further configured to cause the overhead display device to display a player avatar celebration graphic presentation in which the player avatar is shown in a celebration animation.

7. The wagering game system of claim 6 wherein the celebration animation is selected from a number of different player-selectable celebration animations.

8. The wagering game system of claim 1 wherein the one or more processors are further configured to cause the display device displaying the player avatar presentation to display a player avatar celebration graphic display in which the player avatar is shown in a celebration animation.

9. The wagering game system of claim 8 wherein the celebration animation is selected from a number of different player-selectable celebration animations.

10. The wagering game system of claim 1 wherein the player avatar presentation includes a generic player avatar and wherein the one or more processors are further configured to cause the display device displaying the player avatar presentation to change the generic player avatar to a player-customized player avatar responsive to a login by the player.

11. The wagering game system of claim 1 wherein the one or more processors include an avatar server processor configured to maintain the avatar point value.

12. The wagering game system of claim 11 wherein the one of more processors include a web server providing a web interface enabling the player to customize the player avatar.

13. The wagering game system of claim 12 wherein the web interface enables the player to modify the avatar point value.

14. A wagering game system including:

(a) a player interface system enabling a player to initiate a wager for a play in a wagering game;

(b) a display device; and (c) one or more processors configured to:

(i) cause the display device to display a player avatar presentation including at least one player avatar and also including an avatar point value in an avatar point display area of the player avatar presentation, (ii) cause the player avatar presentation to include a customization for the player avatar responsive to a redemption of avatar points from the avatar point value, (iii) cause the one or more display devices to display a game presentation showing an outcome for the play in the wagering game, a win value for the outcome, and a remaining credit value for the player, the game presentation being displayed concurrently with the player avatar presentation, and the remaining credit value and win value being separate from the avatar point value, and (iv) cause the player avatar to present an animation responsive to the outcome, the presented animation being selected from at least two different animations wherein each different animation corresponds to a particular outcome type in the game.

15. The wagering game system of claim 14 wherein the game presentation and player avatar presentation are displayed concurrently in separate distinct windows on the display device.

16. The wagering game system of claim 14 wherein the one or more processors are further configured to cause the area of the avatar presentation to change to an avatar trophy wall presentation including at least one avatar award symbol for an award which has been obtained for the player avatar.

17. The wagering game system of claim 14 wherein the one or more processors are further configured to cause the display device to display an avatar award ceremony including an animation of a pin up presenter presenting the player avatar with an avatar award.

18. The wagering game system of claim 17 wherein the pin up presenter is selected from a number of different player-selectable pin up presenter options.

19. A method of operating a gaming machine, the method including:

(a) accepting a wager through a wager input mechanism;

(b) under control of one or more processors associated with the gaming machine, initiating a play in a game for the wager;

(c) under control of the one or more processors associated with the gaming machine, causing a display device associated with the gaming machine to display a player avatar presentation including at least one player avatar and also including an avatar point value in an avatar point display area of the player avatar presentation;

(d) under control of the one or more processors associated with the gaming machine, causing the player avatar presentation to include a customization for the player avatar responsive to a redemption of avatar points from the avatar point value;

(e) under control of the one or more processors associated with the gaming machine, causing the one or more display devices to display a game presentation showing an outcome for the play in the game, a win value for the outcome, and a remaining credit value for the player, the game presentation being displayed concurrently with the player avatar presentation, and the remaining credit value and win value being separate from the avatar point value; and (f) under control of the one or more processors associated with the gaming machine, causing the player avatar to present an animation responsive to the outcome, the presented animation being selected from at least two different animations wherein each different animation corresponds to a particular outcome type in the game.

20. The method of claim 19 further including, under control of the one or more processors associated with the gaming machine, displaying the game presentation and player avatar presentation concurrently in separate distinct windows on one of the one or more display devices.

21. The method of claim 19 further including, under control of the one or more processors associated with the gaming machine, causing the area of the avatar presentation to change to an avatar trophy wall presentation including at least one avatar award symbol for an award which has been obtained for the player avatar.

22. The method of claim 19 further including, under control of the one or more processors associated with the gaming machine, causing one of the one or more display devices to display an avatar award ceremony including an animation of a pin up presenter presenting the player avatar with an avatar award.

23. The method of claim 22 wherein the pin up presenter is selected from a number of different player-selectable pin up presenter options.

24. The method of claim 19 further including, under control of the one or more processors associated with the gaming machine, causing an overhead display device associated with two or more separate gaming machines to display a player avatar celebration graphic presentation in which the player avatar is shown in a celebration animation.

25. The method of claim 19 wherein the player avatar presentation includes a generic player avatar and further including, under control of the one or more processors associated with the gaming machine, causing the display device displaying the player avatar presentation to change the generic player avatar to a player-customized player avatar responsive to a login by the player.

* * * * *